US012441514B1

(12) United States Patent
Richter et al.

(10) Patent No.: US 12,441,514 B1
(45) Date of Patent: Oct. 14, 2025

(54) BREAKAWAY CONTAINER

(71) Applicant: Naval Information Warfare Center Pacific, San Diego, CA (US)

(72) Inventors: Jason H Richter, Alpine, CA (US); Leif E Roth, Chula Vista, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 18/635,120

(22) Filed: Apr. 15, 2024

(51) Int. Cl.
*B65D 21/08* (2006.01)

(52) U.S. Cl.
CPC ..... *B65D 21/086* (2013.01)

(58) Field of Classification Search
CPC .. B65D 21/086; B65D 11/18; B65D 11/1866; B65D 11/1873; B65D 2501/24184; B65D 1/225; B65D 7/24; B65D 7/30; B65D 9/38
See application file for complete search history.

(56) References Cited

U.S. PATENT DOCUMENTS 1,493,933 A * 5/1924 Gibbons ..... B65D 7/24 220/684
1,500,917 A * 7/1924 Bell ..... B65D 7/24 47/66.1
1,648,859 A * 11/1927 Mittinger ..... B65D 7/24 220/309.1
1,686,222 A * 10/1928 Adler ..... B65D 7/24 220/7
1,689,068 A * 10/1928 Brown ..... B65D 7/24 220/4.08
1,732,128 A * 10/1929 Howcott ..... B65D 7/24 217/44
1,752,134 A * 3/1930 Woodman ..... B65D 7/30 220/4.09
2,143,436 A * 1/1939 Edgin ..... B65D 7/24 217/74
2,613,834 A * 10/1952 Gill ..... B65D 9/24 217/69
3,526,333 A * 9/1970 Formo, Jr. ..... B65D 9/12 217/66
2009/0071956 A1* 3/2009 Lin ..... B65F 1/02 220/4.31
2014/0209600 A1* 7/2014 Schloesser ..... B65D 9/12 220/4.33
2017/0073109 A1* 3/2017 Zhang ..... B65D 21/083
2019/0127113 A1* 5/2019 Cooper ..... B65D 25/06
2019/0344928 A1* 11/2019 Serlin ..... A47J 27/002
(Continued)

*Primary Examiner* — Don M Anderson
(74) *Attorney, Agent, or Firm* — Naval Information Warfare Center Pacific; Kyle Eppele

(57) ABSTRACT

A breakaway container includes two or more rigid panels, two or more end caps, one or more tension bands, and one or more release mechanisms. The one or more tension bands are wrapped around the two or more rigid panels. Each tension band has at least one release mechanism attached to hold each tension band together and are configured to activate and release the one or more tension bands. The two or more rigid panels and the two or more end caps include edges where the edges of the two or more rigid panels and the edges of the two or more end caps fit together and transfer a load to the one or more tension bands to form an enclosed shape with a hollow open space within the enclosed shape.

15 Claims, 6 Drawing Sheets

(56) References Cited

U.S. PATENT DOCUMENTS

| | | | | |
|---|---|---|---|---|
| 2020/0270021 | A1* | 8/2020 | Elstone, Sr. | B65D 21/086 |
| 2022/0024640 | A1* | 1/2022 | Singh | B65D 21/086 |
| 2022/0211196 | A1* | 7/2022 | Lim | B65D 85/72 |
| 2022/0348380 | A1* | 11/2022 | Austin | B65D 21/086 |
| 2023/0008715 | A1* | 1/2023 | Smith | B65D 81/20 |
| 2023/0210295 | A1* | 7/2023 | Anderson | H04N 7/181 |
| 2024/0017880 | A1* | 1/2024 | Asensio Cotillas | B65D 19/06 |
| 2024/0191928 | A1* | 6/2024 | Bollinger | B65D 21/086 |
| 2024/0343473 | A1* | 10/2024 | Scherrer | B65D 85/816 |

* cited by examiner

BREAKAWAY CONTAINER

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor. Licensing and technical inquiries may be directed to the Office of Research and Technical Applications, Naval Information Warfare Center Pacific, Code 72120, San Diego, CA, 92152; (619) 553-5118; NIWC_Pacific_T2@us.navy.mil. Reference Navy Case Number 211362.

BACKGROUND

Transporting a system or device in a container is useful for a variety of reasons. For example, a container can protect a system or device from weather elements, provide an easier means of transporting the system or device, and can protect the system or device from damage prior to deploying or using the system or device. In some applications, containers have a need to open and deploy the system or device without an individual physically opening the container or without an individual physically moving the system or device outside the container. In those applications, a breakaway container that falls into several pieces when opened is useful.

DESCRIPTION OF THE DRAWINGS

Features and advantages of examples of the present disclosure will be apparent by reference to the following detailed description and drawings, in which like reference numerals correspond to similar, but in some instances, not identical, components. Reference numerals or features having a previously described function may or may not be described in connection with other drawings in which they appear.

DETAILED DESCRIPTION

Breakaway containers can come in different shapes and sizes depending on the application. However, current breakaway containers may require multiple release mechanisms. Breakaway containers that use only a single release mechanism may be flimsy or unable to be handled as if the container were made as a single piece. Some breakaway containers may require physical intervention to break the container apart either because the release mechanism requires physical intervention or the container does not completely break apart to release the device or system.

In contrast, the breakaway container herein can operate with only a single release mechanism without compromising the integrity of the container. Even with a single release mechanism, the breakaway container can be handled as if the breakaway container is a single piece. This is due to the design of the rigid panels and the end caps in the breakaway container. In addition, the breakaway container can open passively without physical intervention with the use of a passive release mechanism and a design that allows the breakaway container to completely break apart without any obstruction.

The breakaway container described herein includes two or more rigid panels, two or more end caps, one or more tension bands, and one or more release mechanisms. The one or more tension bands are wrapped around the two or more rigid panels. Each tension band has at least one release mechanism attached to hold each tension band together and are configured to activate and release the one or more tension bands. The two or more rigid panels and the two or more end caps include edges where the edges of the two or more rigid panels and the edges of the two or more end caps fit together and transfer a load to the one or more tension bands to form an enclosed shape with a hollow open space within the enclosed shape.

Figure 1:
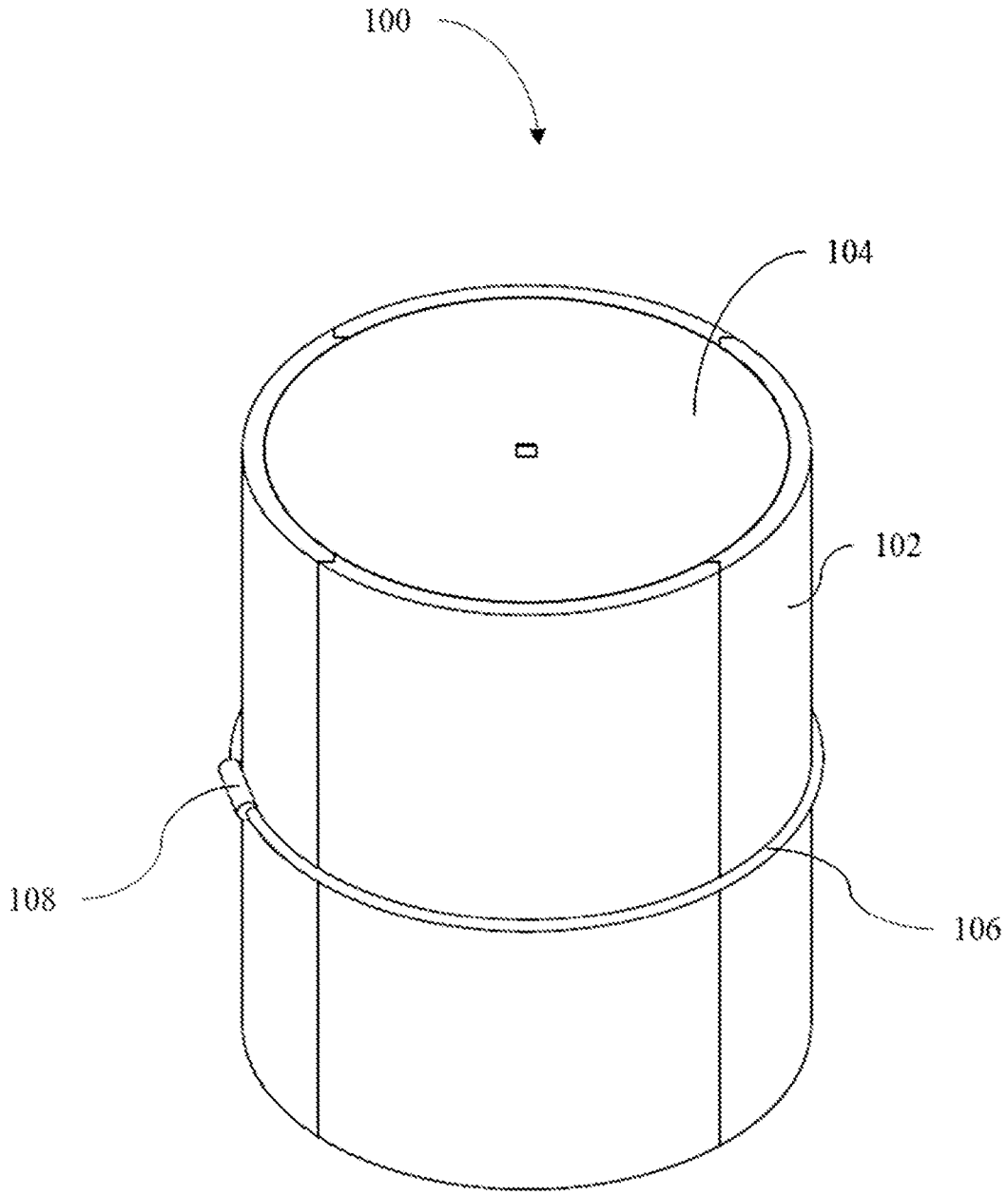
FIG. 1 is a perspective view of an example of the breakaway container in an enclosed state.

Referring now to FIG. 1, an example of the breakaway container 100 in an enclosed state is shown. FIG. 1 is for illustrative purposes only to aid in viewing and should not be construed as being limiting or directed to a particular material or materials. The breakaway container 100 includes two or more rigid panels 102. In the example shown in FIG. 1, the breakaway container 100 includes four rigid panels 102. In other examples, two or eight rigid panels 102 may be used. However, the number of rigid panels 102 used is not limited to these examples. The rigid panels 102 may be any size and material suitable for a particular application. For example, if the breakaway container is being used in ocean, the rigid panels 102 may be a material that is resistant to corrosion.

Referring back to FIG. 1, the breakaway container 100 includes two or more end caps 104. In the example in FIG. 1, only one endcap 104 is visible. However, two end caps 104 are being used in the example in FIG. 1. In other examples, the breakaway container 100 may include three or four end caps 104. The number of end caps 104 used is not limited to these examples. The end caps 104 may be any size and material suitable for a particular application. The end caps 104 may be the same or different material as the rigid panels 102. The size of the end caps 104 must be proportional to the rigid panels 102 such that when the end caps 104 are fit together with the rigid panels 102, an enclosed shape is formed.

Figure 2:
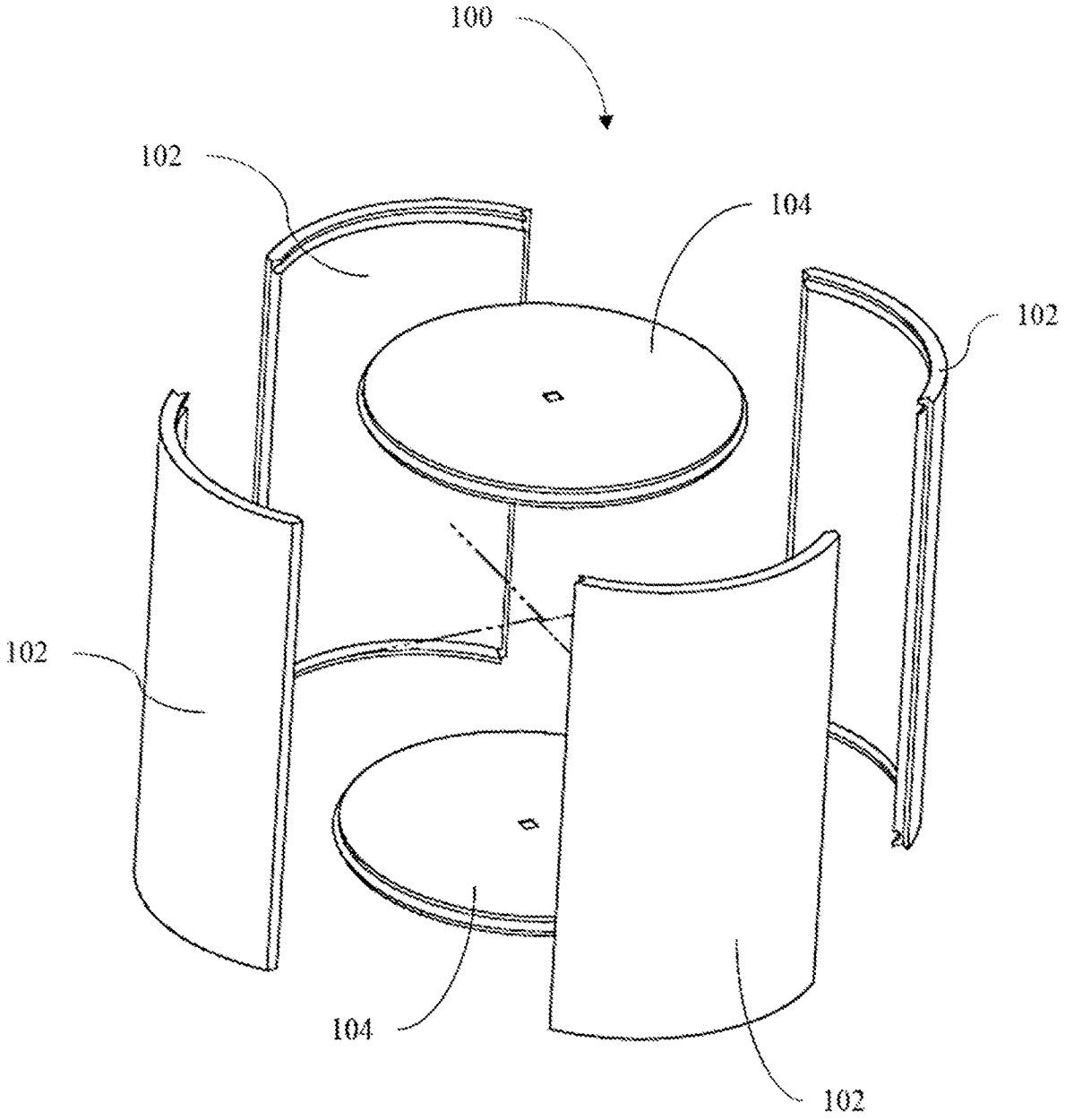
FIG. 2 is an exploded view of an example of the breakaway container without a tension band or a release mechanism.

Referring now to FIG. 2, an exploded view of an example of the breakaway container 100 is shown without the one or more tension bands 106 or the one or more release mechanism 108 attached. FIG. 2 is for illustrative purposes only to aid in viewing and should not be construed as being limiting or directed to a particular material or materials. The example in FIG. 2 is the same breakaway container as FIG. 1, with two end caps 104 and four rigid panels 102 that form an enclosed shape. The enclosed shape may be any shape that can be formed where the edges of each rigid panel 102 are orthogonal to each other. For example, the enclosed shape may be a cylinder or a rectangle. The two or more end caps 104 may be any shape that causes the edges of the two or more end caps 104 to translate force outward into the two or more rigid panels 102. The two or more rigid panels 102 would then transfer that force outward into the one or more tension bands 106. When the breakaway container 100 forms an enclosed shape, a hollow open space is formed inside that may include an object within the enclosed shape. Any object that can fit into the breakaway container 100 may be within the enclosed shape. Some examples include chains, rope, buoys, sensors or sensor systems, or any heavy object.

Referring back to FIG. 1, the breakaway container 100 includes one or more tension bands 106 where the one or more tension bands 106 are wrapped around the two or more rigid panels 102. In the example shown in FIG. 1, the breakaway container 100 consists of one tension band 106. In other examples, two tension bands 106 may be used. However, the number of tension bands 106 used is not limited to these examples. In an example, the one or more tension bands 106 may be any material that has sufficient axial stiffness to maintain the enclosed shape of the breakaway container 100. Any known tension band 106 may be used that has sufficient axial stiffness, but can loosen upon release to allow the rigid panels 102 to break away. Some examples of the one or more tension bands 106 include wires, bands, strings, plastic rods, plastic filaments, rope, or combinations thereof.

Referring back to FIG. 1, the breakaway container 100 includes one or more release mechanisms 108 where each tension band 106 has at least one release mechanism 108 attached to hold each tension band 106 together and are configured to activate and release the one or more tension bands 106. In the example shown in FIG. 1, the breakaway container 100 consists of one release mechanism 108. In other examples, two release mechanisms 108 may be used. However, the number of release mechanisms 108 used is not limited to these examples. Any passive or active release mechanism 108 may be used. Some examples include a galvanic release mechanism, a mechanical or digital timed-release mechanism, an electro-mechanical release mechanism, or a combination thereof.

Figure 3:
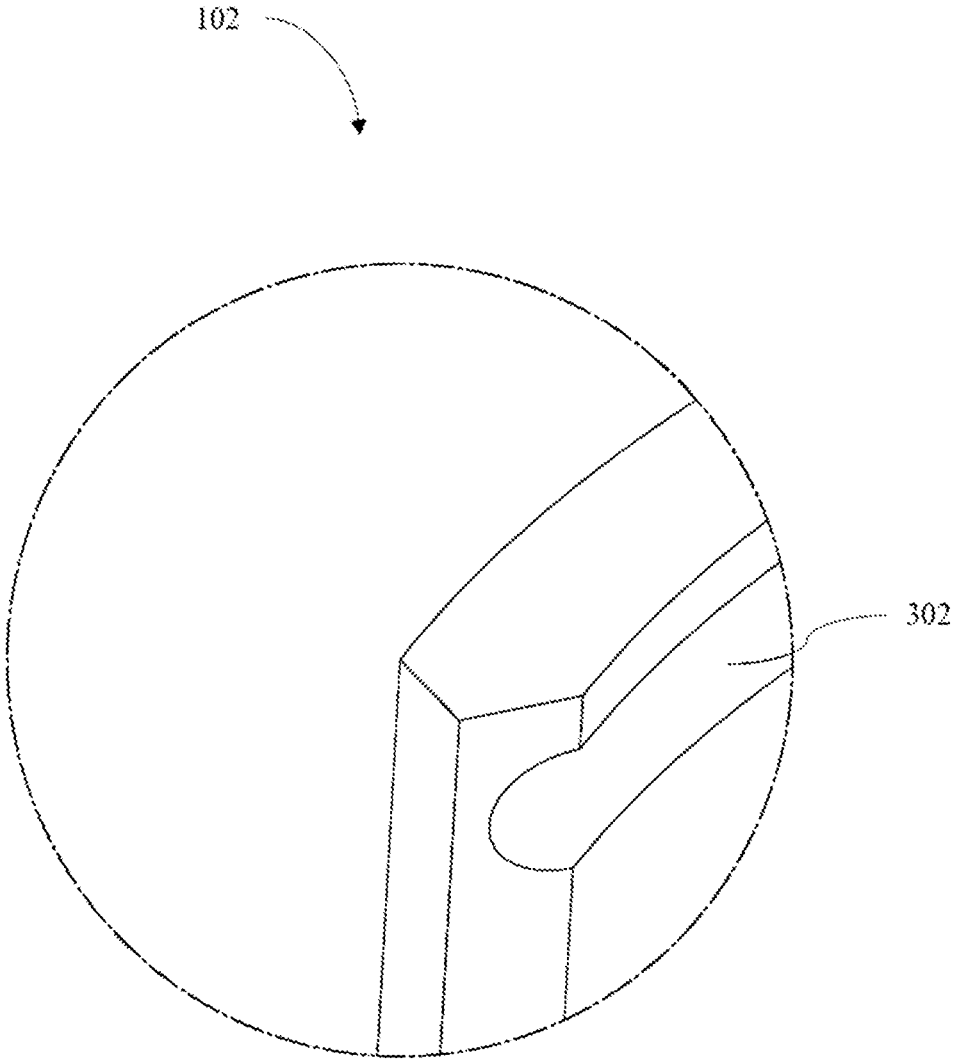
FIG. 3 is a magnified view of an example of the tongue and groove design on one of the rigid panels of the breakaway container.
Figure 4:
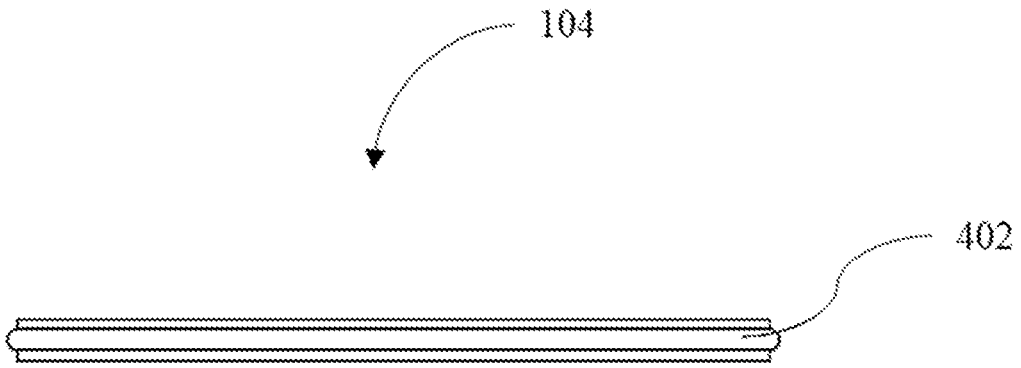
FIG. 4 is a side view of an example of an endcap of the breakaway container.

Referring now to FIG. 3 and FIG. 4, an example of a magnified view of a rigid panel 102 and a side view of an endcap 104 are shown respectively. FIG. 3 and FIG. 4 are for illustrative purposes only to aid in viewing and should not be construed as being limiting or directed to a particular material or materials. The two or more rigid panels 102 and the two or more end caps 104 include edges where the edges of the two or more rigid panels 102 and the edges of the two or more end caps 104 fit together and transfer a load to the one or more tension bands 106 to form an enclosed shape with a hollow open space within the enclosed shape. The edges of the two or more rigid panels 102 and the edges of the two or more end caps 104 may be any form of joinery that prevents two or more rigid panels 102 from shearing out of plane until the release mechanism 108 is activated. Some examples of the edges of the two or more rigid panels 102 and the edges of the two or more end caps 104 may be tongue and grove edges, V-groove edges, interlocking joint, matched joint, edge joint, board to boar joint, or a combination thereof. In the examples in FIG. 3 and FIG. 4, the rigid panels 102 have a groove 302 along the edge that allows the tongue 402 of the end cap 104 to fit into the groove 302 of the rigid panel. When a tension band 106 is applied and held in place by the release mechanism 108, the end caps 104 and rigid panels 102 are held in place. The joinery of the rigid panels 102 and end caps 104 are not limited to particular size, but are proportional to the size of the rigid panels 102 and end caps 104.

Referring back to FIG. 1, in another example, the breakaway container 100 may consist of the example shown in FIG. 1. Specifically, the breakaway container 100 may consist of four rigid panels 102, two end caps 104, one tension band 106, and one release mechanism 108 without any additional components. The four rigid panels 102, two end caps 104, one tension band 106, and one release mechanism 108 are the same rigid panels 102, end caps 104, tension band 106, and release mechanism 108 as previously disclosed herein.

Figure 5:
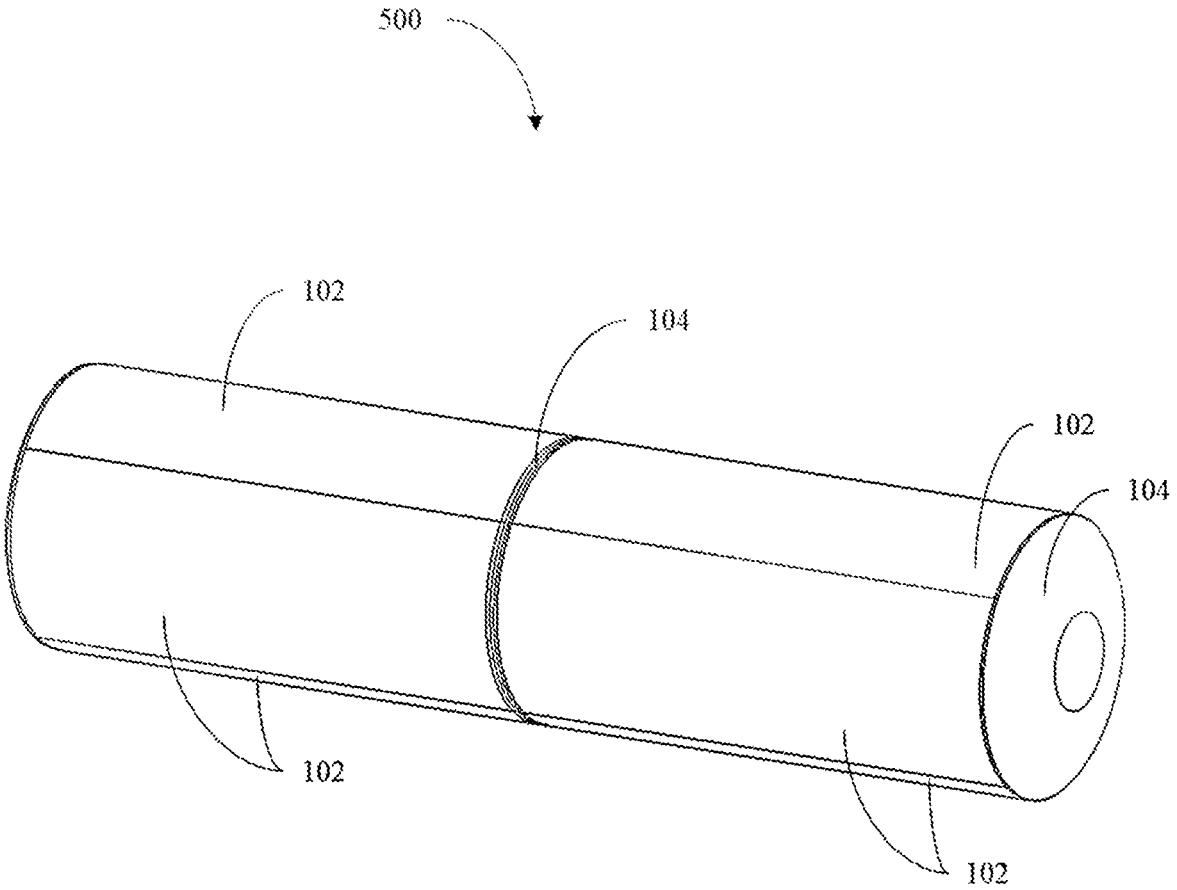
FIG. 5 is a perspective view of another example of a breakaway container without a tension band or a release mechanism.
Figure 6:
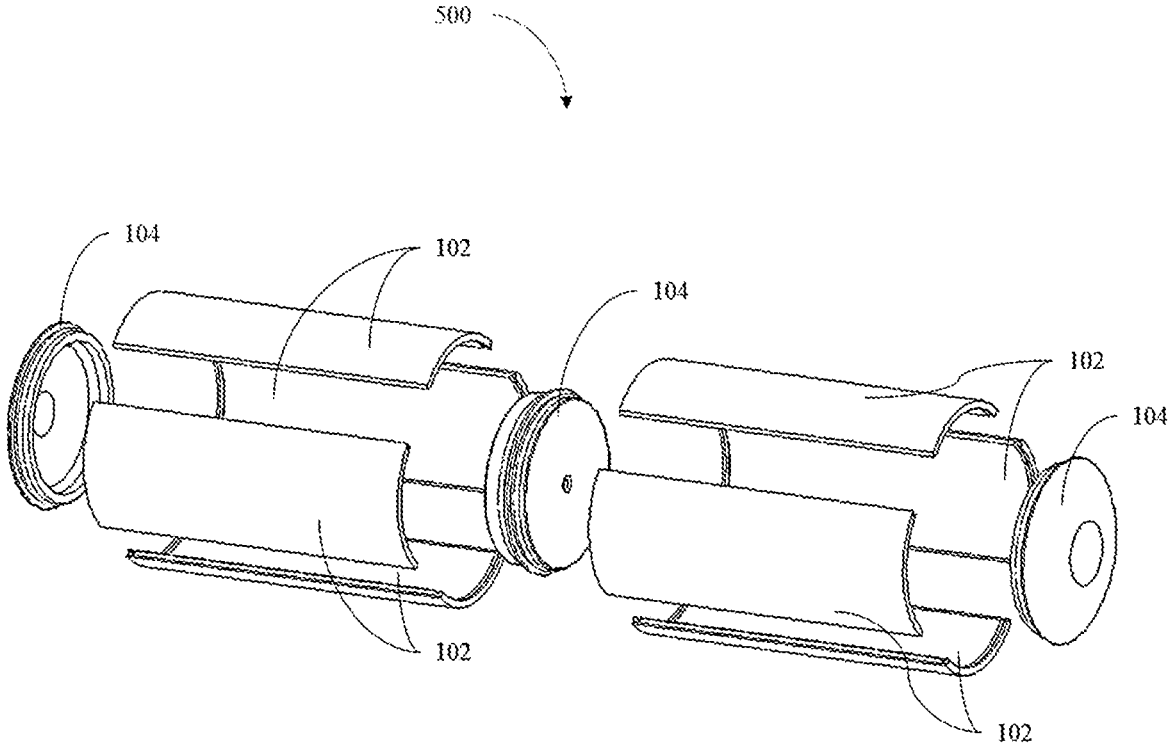
FIG. 6 is an exploded view of another example of a breakaway container without a tension band or a release mechanism.

Referring now to FIG. 5 and FIG. 6, a perspective view of another example of a breakaway container 500 without a tension band 106 or a release mechanism 108 is shown. FIG. 6 shows an exploded view of the same example of the breakaway container 500 shown in FIG. 5. FIG. 5 and FIG. 6 are for illustrative purposes only to aid in viewing and should not be construed as being limiting or directed to a particular material or materials. In this example, the breakaway container 500 would have eight rigid panels 102, three end caps 104, two tension bands 106 (not depicted), and two release mechanisms 108 (not depicted) when full enclosed. The eight rigid panels 102, three end caps 104, two tension bands 106 (not depicted), and two release mechanisms 108 (not depicted) are the same rigid panels 102, end caps 104, tension band 106, and release mechanism 108 used as previously disclosed herein. In the example in FIG. 5 and FIG. 6, the middle end cap 104 is double sided with two tongues 402 on each side to fit into the grooves 302 of each set of rigid panels 102. In another example, the breakaway container 500 may include three or more breakaway containers 100 stacked together depending on the application.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of a list should be construed as a de facto equivalent of any other member of the same list merely based on their presentation in a common group without indications to the contrary.

Unless otherwise stated, any feature described herein can be combined with any aspect or any other feature described herein.

Reference throughout the specification to "one example", "another example", "an example", means that a particular element (e.g., feature, structure, and/or characteristic) described in connection with the example is included in at least one example described herein, and may or may not be present in other examples. In addition, the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

What is claimed is:

1. A breakaway container, comprising: two or more rigid panels; two or more end caps; wherein the breakaway container consists of one tension band and consists of a single release mechanism, wherein the tension band is wrapped around the two or more rigid panels; wherein the tension band has the release mechanism attached to hold the tension band together and is configured to activate and release the tension band; and wherein the two or more rigid panels and the two or more end caps include edges where the edges of the two or more rigid panels and the edges of the two or more end caps fit together and transfer a load to the tension band to form an enclosed shape with a hollow open space within the enclosed shape.

2. The breakaway container of claim 1, wherein the edges are tongue and grove edges, V-groove edges, interlocking joint, matched joint, edge joint, board to boar joint, or a combination thereof.

3. The breakaway container of claim 1, wherein the enclosed shape is a cylinder or a rectangle.

4. The breakaway container of claim 1, wherein the release mechanism is a galvanic release mechanism, a mechanical or digital timed-release mechanism, an electro-mechanical release mechanism, or a combination thereof.

5. The breakaway container of claim 1, wherein there are four rigid panels and two end caps.

6. The breakaway container of claim 1, wherein the two or more end caps are a shape selected from the group consisting of a cylinder or a rectangle that causes the edges of the two or more end caps to translate the load outward into the two or more rigid panels.

7. A breakaway container comprising:

eight rigid panels;

three end caps;

one or more tension bands, wherein the one or more tension bands are wrapped around the eight rigid panels;

one or more release mechanisms, wherein each tension band has at least one release mechanism attached to hold each tension band together and are configured to activate and release the one or more tension bands; and wherein the eight rigid panels and the three end caps include edges where the edges of the eight rigid panels and the edges of the three end caps fit together and transfer a load to the one or more tension bands to form an enclosed shape with a hollow open space within the enclosed shape.

8. The breakaway container of claim 7, wherein two tension bands are used.

9. The breakaway container of claim 1, wherein the one or more tension bands are wires, bands, strings, plastic rods, plastic filaments, rope, or combinations thereof.

10. A breakaway container consisting of:

four rigid panels;

two end caps;

a tension band, wherein the tension band is wrapped around the four rigid panels;

a release mechanism, wherein the tension band has the release mechanism attached to hold the tension band together and is configured to activate and release the tension band; and wherein the four rigid panels and the two end caps include edges where the edges of the four rigid panels and the edges of the two end caps fit together and transfer a load to the tension band to form the enclosed shape with a hollow open space within the enclosed shape.

11. The breakaway container of claim 10, are tongue and grove edges, V-groove edges, interlocking joint, matched joint, edge joint, board to boar joint, or a combination thereof.

12. The breakaway container of claim 10, wherein the enclosed shape is a cylinder or a rectangle.

13. The breakaway container of claim 10, wherein the enclosed shape includes an object in the hollow open space within the enclosed shape.

14. The breakaway container of claim 10, wherein the release mechanism is a galvanic release mechanism, a mechanical or digital timed-release mechanism, an electro-mechanical release mechanism, or a combination thereof.

15. The breakaway container of claim 10, wherein the two or more end caps are a shape selected from the group consisting of a cylinder or a rectangle that causes the edges of the two or more end caps to translate force outward into the two or more rigid panels.

* * * * *